US011146005B2

(12) United States Patent
Chen

(10) Patent No.: US 11,146,005 B2
(45) Date of Patent: Oct. 12, 2021

(54) SURFACE MOUNT CONNECTOR

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 16/828,973

(22) Filed: Mar. 25, 2020

(65) Prior Publication Data

US 2021/0273359 A1 Sep. 2, 2021

(30) Foreign Application Priority Data

Feb. 28, 2020 (CN) ..... 202020231720.X

(51) Int. Cl.
*H01R 12/75* (2011.01)
*H01R 13/506* (2006.01)
*H01R 13/58* (2006.01)

(52) U.S. Cl.
CPC ..... *H01R 12/75* (2013.01); *H01R 13/506* (2013.01); *H01R 13/582* (2013.01)

(58) Field of Classification Search
None
See application file for complete search history.

(56) References Cited

U.S. PATENT DOCUMENTS 9,941,630 B2 * 4/2018 Sato ..... H01R 13/6272
2006/0094306 A1 * 5/2006 Masaki ..... H01R 13/567 439/850
2010/0267269 A1 * 10/2010 Umehara ..... H01R 13/627 439/345
2020/0212628 A1 * 7/2020 Shimonishi ..... H01R 13/11

* cited by examiner

*Primary Examiner* — Oscar C Jimenez

(57) ABSTRACT

A surface mount connector comprises a bottom plate having a bottom wall, a conductive sheet disposed on the bottom plate and having a bottom portion running through the bottom wall and weldable to a PCB, a housing detachably disposed on the bottom plate and provided with a mounting hole corresponding to the conductive sheet, a conductive clamp disposed in the mounting hole, and a clamping piece portion adaptive to the conductive sheet disposed on the conductive clamp. The housing is capable of driving the conductive clamp to the bottom plate from top to bottom, so that the conductive sheet can insert into the clamping piece portion. The conductive clamp is electrically connected to the conductive sheet. The housing can drive the conductive clamp to detach from the bottom plate from bottom to top, so that the conductive clamp can disconnect from the conductive sheet.

7 Claims, 6 Drawing Sheets

SURFACE MOUNT CONNECTOR

CROSS-REFERENCE TO RELATED APPLICATIONS

The present application claims the benefit under 35 U.S.C. § 119 of China Patent Application No. 202020231720.X, filed on Feb. 28, 2020 in the China National Intellectual Property Administration, the content of which is hereby incorporated by reference.

TECHNICAL FIELD

The present disclosure relates to the field of connector technologies, and specifically, to a surface mount connector.

BACKGROUND

A surface mount electrical connector is a connector electrically connected to a PCB through welding, and a conducting wire or a male end connector may be electrically connected to the PCB by using the surface mount electrical connector.

Currently, the surface mount electrical connector generally includes a housing and a conductive clamp directly welded to the PCB, and no detachment or no long-term reliable repeated detachment can be performed between the conductive clamp and the housing. Consequently, when necessary, the conducting wire or the male end connector cannot be disconnected from the PCB. In view of this, this application is filed after the prior art is researched.

SUMMARY

The present disclosure provides a surface mount connector, to resolve a prior-art problem that a conducting wire or a male end connector connected to the surface mount electrical connector cannot be detachably and electrically connected to a PCB.

The present disclosure provides a surface mount connector. The surface mount connector comprises: a bottom plate, a conductive sheet, a housing and a conductive clamp. The bottom plate has a bottom wall. The conductive sheet is vertically disposed on the bottom plate, and a bottom portion of the conductive sheet runs through the bottom wall, so that the bottom portion can be welded into a PCB. The housing is detachably disposed on the bottom plate, and is provided with a mounting hole corresponding to the conductive sheet. The conductive clamp is disposed in the mounting hole, and a clamping piece portion adaptive to the conductive sheet is disposed on the conductive clamp. The housing is capable of driving the conductive clamp to be disposed on the bottom plate from a top to a bottom, so that the conductive sheet is inserted into the clamping piece portion, and the conductive clamp is electrically connected to the conductive sheet.

In some embodiments, the bottom plate has a pair of first side walls that are roughly parallelly disposed on the bottom wall and protrude outward, and a second side wall that is disposed on the bottom wall and protrudes outward, the second side wall is roughly perpendicular to the first side walls, and two ends of the second side wall are respectively connected to the pair of first side walls.

In some embodiments, the conductive sheet is inserted into the first side wall from back to front.

In some embodiments, the conductive sheet has a body portion, a first limiting portion that is connected to the body portion and extends forward in a direction roughly parallel to the body portion, and a second limiting portion that is connected to the body portion and extends outwards in a direction roughly perpendicular to the body portion. A first clamping portion and a second clamping portion respectively adaptive to the first limiting portion and the second limiting portion are disposed on the second side wall.

In some embodiments, the surface mount connector includes a pair of auxiliary weld legs respectively disposed on the pair of first side walls, and the weld legs can be welded to the PCB.

In some embodiments, a first buckling portion located at a front end of the housing and a pair of second engaging portions respectively located on two sides of the housing are disposed on the housing. Third engaging portions adaptive to the second engaging portions are respectively disposed on the pair of first side walls, and a fourth buckling portion adaptive to the first buckling portion is disposed on the second side wall.

In some embodiments, a cutting edge portion adaptive to the clamping piece portion is disposed at an upper portion of the body portion, and a thickness of the cutting edge portion decreases in an upward direction.

In some embodiments, a clamping wire portion connected to the clamping piece portion is disposed on the conductive clamp, and the clamping wire portion is used to connect to a conducting wire.

In some embodiments, a clamping sheet extending obliquely outwards is disposed at a bottom portion of the conductive clamp, and the clamping sheet is capable of clamping on the housing.

Based on the foregoing technical solutions, the present disclosure may obtain the following technical effects:

The surface mount electrical connector in the present disclosure may implement a connection or a disconnection between the conducting wire and the PCB. Specifically, the housing and the conductive clamp form a whole, and the conducting wire is inserted into the mounting hole in advance, so that the conducting wire is electrically connected to the conductive clamp. The housing may drive the conducting wire to be mounted on the bottom plate from top to bottom, so that the conductive sheet disposed on the bottom plate may be inserted into the conductive clamp, thereby implementing an electrical connection between the conductive sheet and the conductive clamp, so as to implement an electrical connection between the PCB and the conducting wire. When the conducting wire needs to be disconnected from the PCB, the housing and the conductive clamp may drive the conducting wire to be detached from the bottom plate, so that the conducting wire is no longer electrically connected to the PCB.

In addition, the bottom plate welded to a PCB has very small dimensions, and the conductive clamp is blocked by another electronic element on the PCB. Therefore, in an actual operation process, it is not easy to accurately mount the conductive clamp on the bottom plate. However, in this solution, the housing drives the conducting wire to be mounted on the bottom plate from top to bottom. This can greatly facilitate mounting of the housing and the bottom plate, thereby improving assembly efficiency of the housing and the bottom plate.

DETAILED DESCRIPTION

Figure 1:
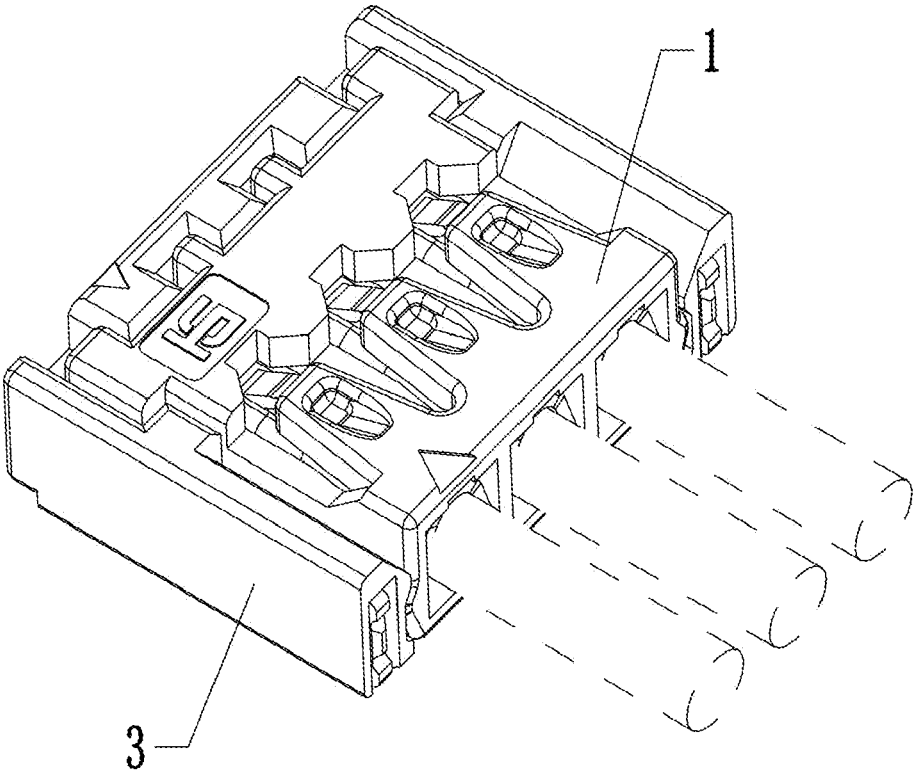
FIG. 1 is a schematic structural diagram on a second shaft side of a surface mount electrical connector according to an embodiment of the present disclosure.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined and defined. Moreover, when a first feature is described to be "over", "above" and "on" the second feature, situations include that the first feature is directly not directly above the second feature, or that the first feature is merely located higher than the second feature. When a first feature is described to be "under", "below" and "down" the second feature, situations include that the first feature is directly or not directly below the second feature, or that the first feature is merely located lower than the second feature.

The present disclosure is further described below in detail with reference to the accompanying drawings and specific implementations.

Figure 2:
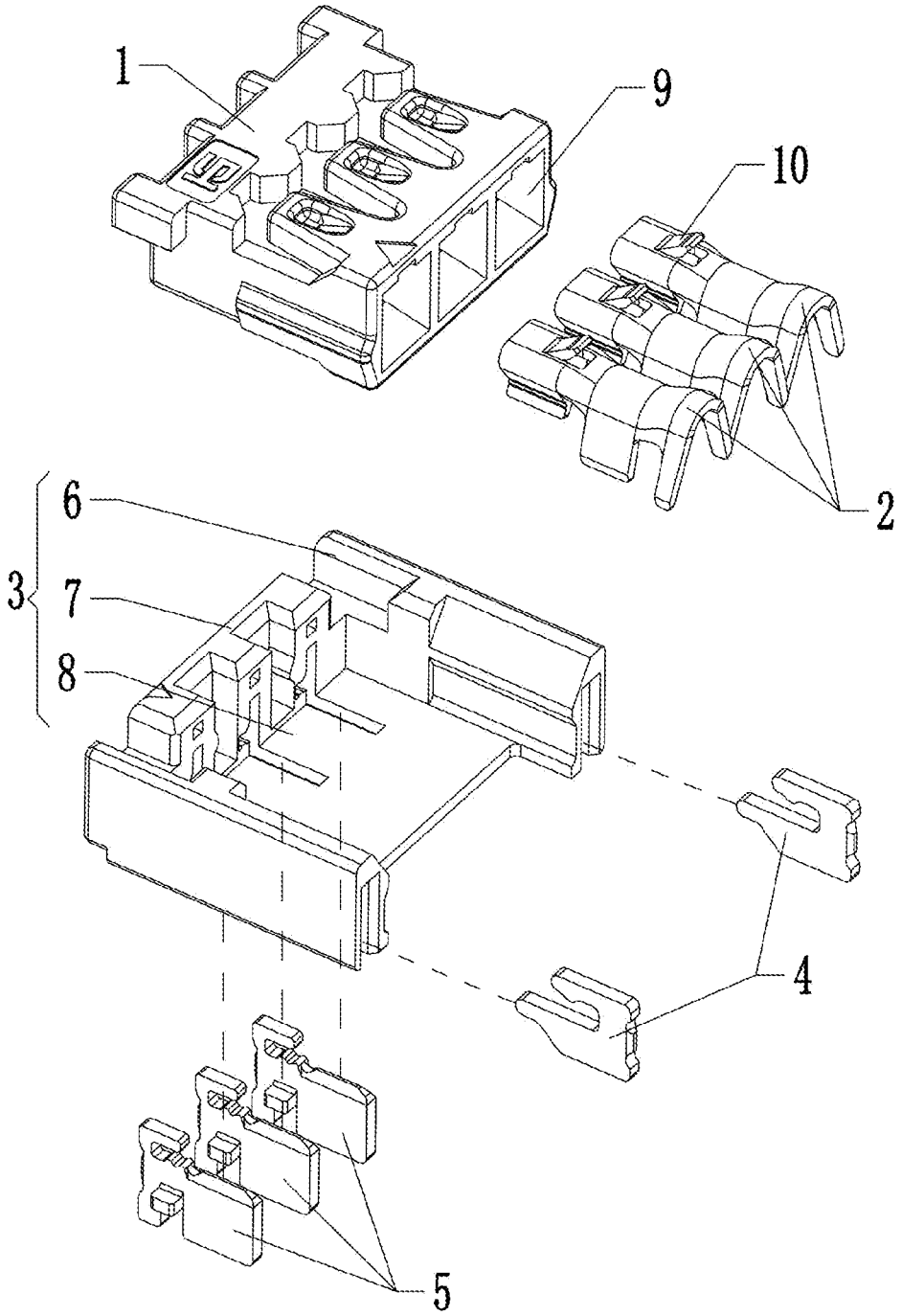
FIG. 2 is a schematic exploded view of a surface mount electrical connector according to an embodiment of the present disclosure.

As shown in FIG. 1 and FIG. 2, in this embodiment, a surface mount connector is provided and includes: a bottom plate 3, a sheet-shaped conductive sheet 5, a housing 1, and a conductive clamp 2.

The bottom plate 3 has a rectangular bottom wall 8, a pair of first side walls 6 that are roughly parallelly disposed on the bottom wall 8 and protrude outward, and a second side wall 7 that is disposed on the bottom wall 8 and protrudes outward. The second side wall 7 is roughly perpendicular to the first side walls 6, and two ends of the second side wall 7 are respectively connected to the pair of first side walls 6. The pair of first side walls 6 are disposed on upper and lower edges of the bottom wall 8, and the second side wall 7 is located on a left edge of the bottom wall 8.

The conductive sheet 5 is vertically disposed on the bottom plate 3, and a bottom portion of the conductive sheet 5 runs through the bottom wall 8, so that the bottom portion can be welded to a PCB. It should be noted that, in this embodiment, the surface mount connector has three conductive sheets 5.

The housing 1 is detachably disposed on the bottom plate 3, and is provided with a mounting hole 9 corresponding to the conductive sheet 5. It should be noted that, in this embodiment, the housing 1 is provided with three mounting holes 9.

Figure 6:
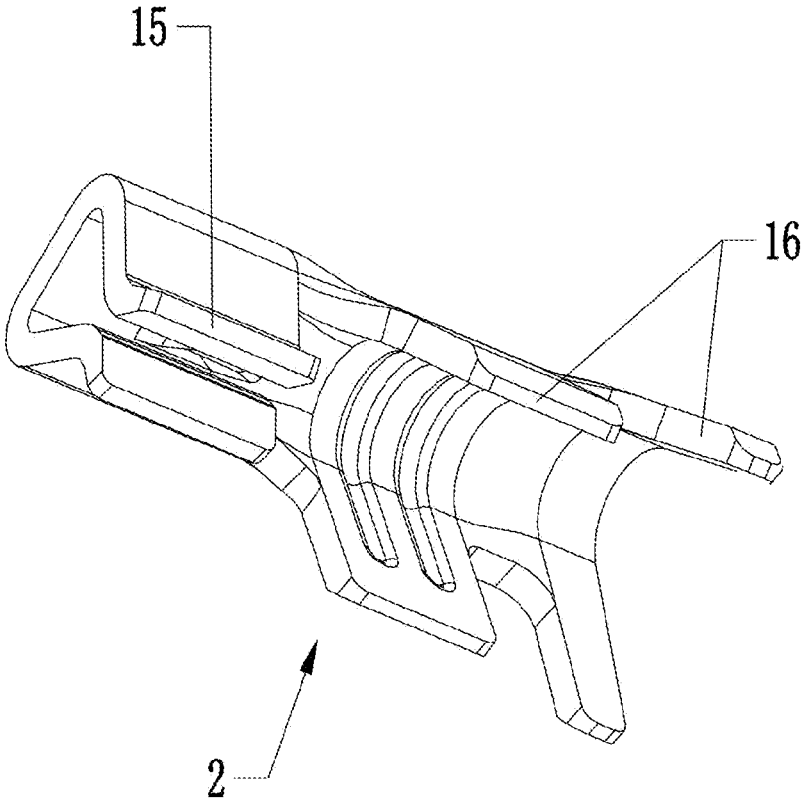
FIG. 6 is a shaft-side schematic structural diagram of a conductive clamp according to an embodiment of the present disclosure.

The conductive clamp 2 is disposed in the mounting hole 9, and a clamping piece portion 15 adaptive to the conductive sheet 5 is disposed on the conductive clamp 2. Specifically, as shown in FIG. 6, the clamping piece portion 15 is a pair of spring plates that first approach each other and then move outwards and away from each other from bottom to top.

In a specific operation process, the housing 1 and the conductive clamp 2 are first assembled to form a whole, and a conducting wire is inserted into the mounting hole 9 in advance, so that the conducting wire is electrically connected to the conductive clamp 2. The bottom plate 3 and the conductive sheet 5 are also first assembled to form a whole. Then the housing 1 may drive the conducting wire to be mounted on the bottom plate 3 from top to bottom, so that the three conductive sheets 5 disposed on the bottom plate 3 are respectively inserted into three conductive clamps 2, thereby implementing a one-to-one electrical connection between the conductive sheets 5 and the conductive clamps 3, so as to implement an electrical connection between the PCB and different conducting wires. However, when the conducting wire needs to be disconnected from the PCB, the housing 1 and the conductive clamp 2 may drive the conducting wire to be detached from the bottom plate 3, so that the conducting wire is no longer electrically connected to the PCB.

Figure 4:
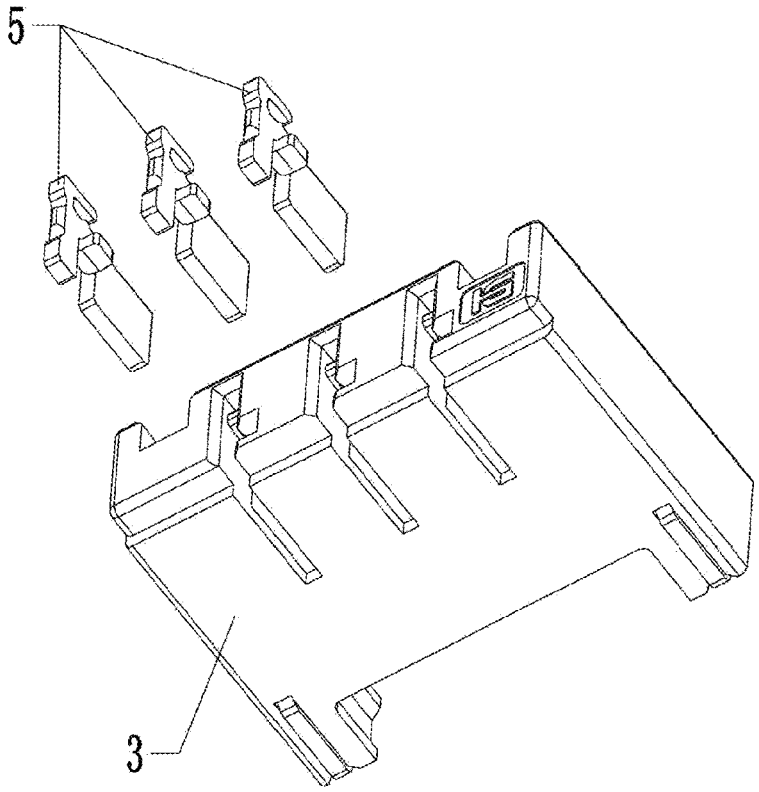
FIG. 4 is a local schematic exploded view of a surface mount electrical connector according to an embodiment of the present disclosure.
Figure 7:
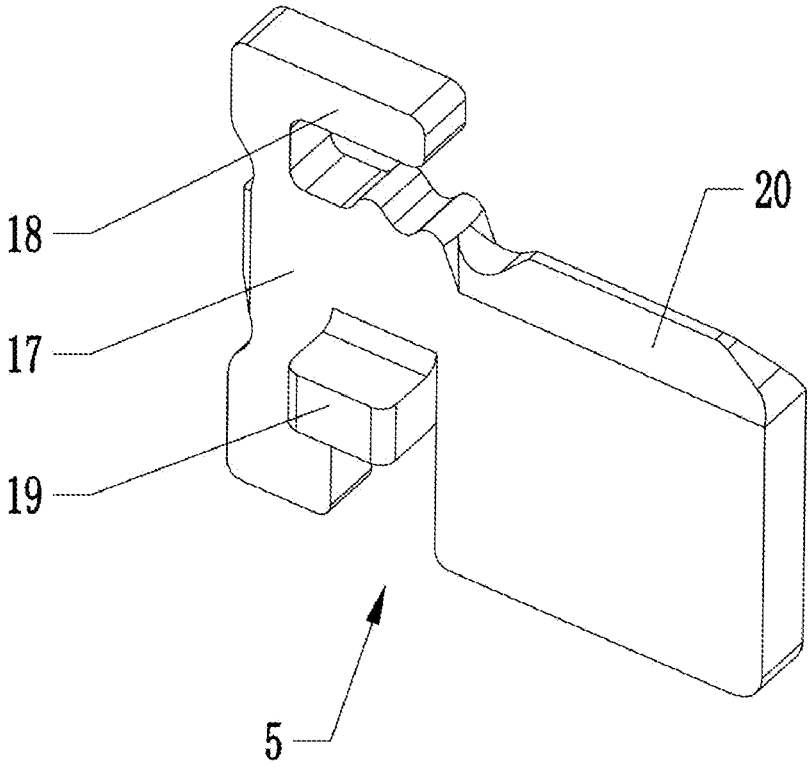
FIG. 7 is a shaft-side schematic structural diagram of a conductive sheet according to an embodiment of the present disclosure.
Figure 8:
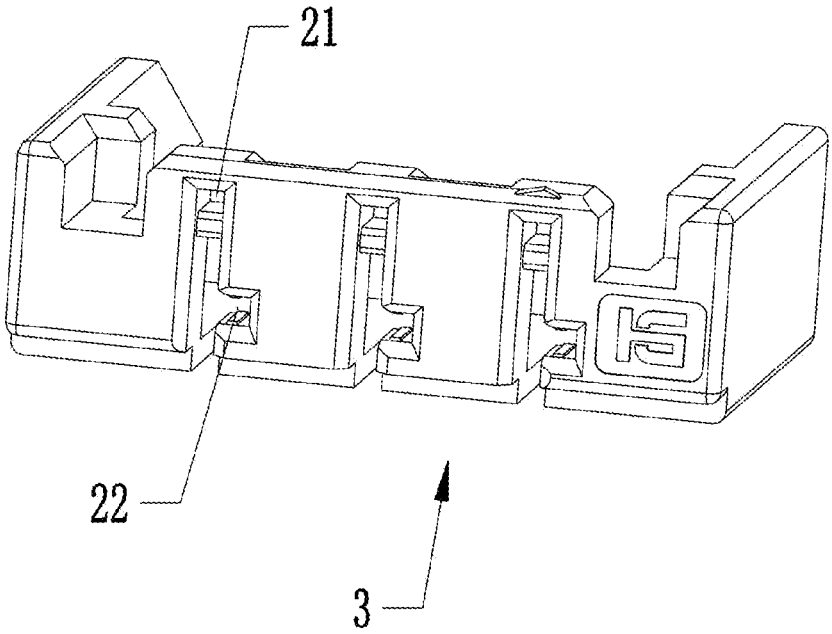
FIG. 8 is a shaft-side schematic structural diagram of a bottom plate according to an embodiment of the present disclosure.

As shown in FIG. 7, in this embodiment, the conductive sheet 5 has a sheet-shaped body portion 17, a first limiting portion 18 that is connected to the body portion 17 and extends forward in a direction roughly parallel to the body portion 17, and a second limiting portion 19 that is connected to the body portion 17 and extends outwards in a direction roughly perpendicular to the body portion 17. As shown in FIG. 4 and FIG. 8, a first clamping portion 21 and a second clamping portion 22 respectively adaptive to the first limiting portion 18 and the second limiting portion 19 are disposed on the second side wall 7. When the conductive sheet 5 is inserted into the first side wall 6 from back to front, the first limiting portion 18 and the second limiting portion 19 can be respectively inserted into the first clamping portion 21 and the second clamping portion 22, so that the conductive sheet 5 is firmly disposed on the bottom plate 3. In this way, when the bottom portion of the conductive sheet 5 is welded to the PCB, the bottom plate 3 can be firmly supported on the PCB by using the conductive sheet 5.

As shown in FIG. 7, a cutting edge portion 20 adaptive to the clamping piece portion 15 is disposed at an upper portion of the body portion 17, and a thickness of the cutting edge portion 20 decreases in an upward direction. The cutting edge portion 20 may enable the conductive sheet 5 to be more smoothly insertable into the clamping piece portion 15.

Figure 3:
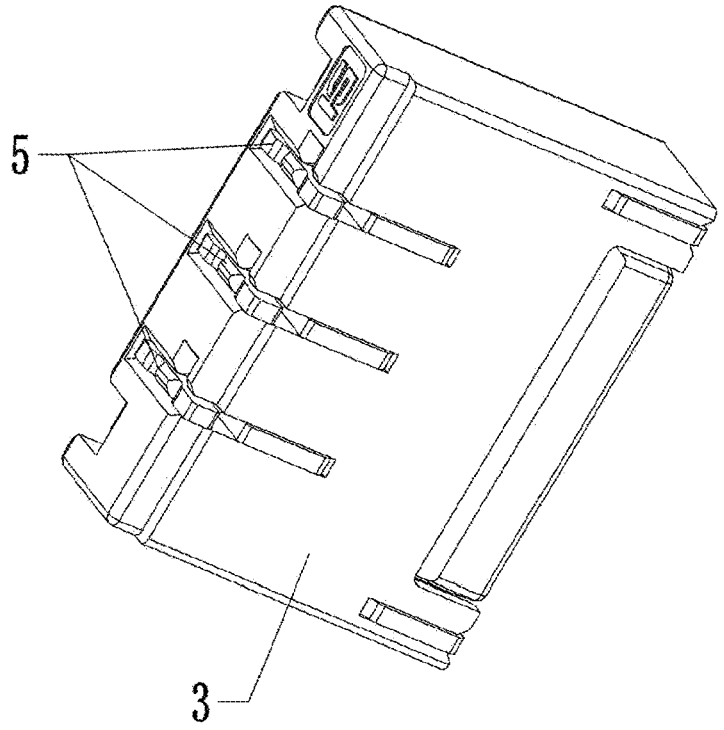
FIG. 3 is a schematic structural diagram on a second shaft side of a surface mount electrical connector according to an embodiment of the present disclosure.

As shown in FIG. 2 and FIG. 3, in this embodiment, the surface mount connector includes a pair of auxiliary weld legs 4 respectively disposed on the pair of first side walls 6. It may be shown from FIG. 2 that the auxiliary weld leg 4 is a sheet-shaped geometry. The pair of auxiliary weld legs 4 is respectively inserted onto the pair of first side walls 6, and a bottom portion of the auxiliary weld leg 4 runs out of a bottom portion of the bottom plate 3, so that the auxiliary weld legs can be welded to the PCB. It should be noted that the auxiliary weld legs 4 only play a role of assisting in fixing the bottom plate 3, so that the bottom plate 3 may be more firmly supported on the PCB. The auxiliary weld legs 4 are not electrically connected to the conducting wire.

Figure 5:
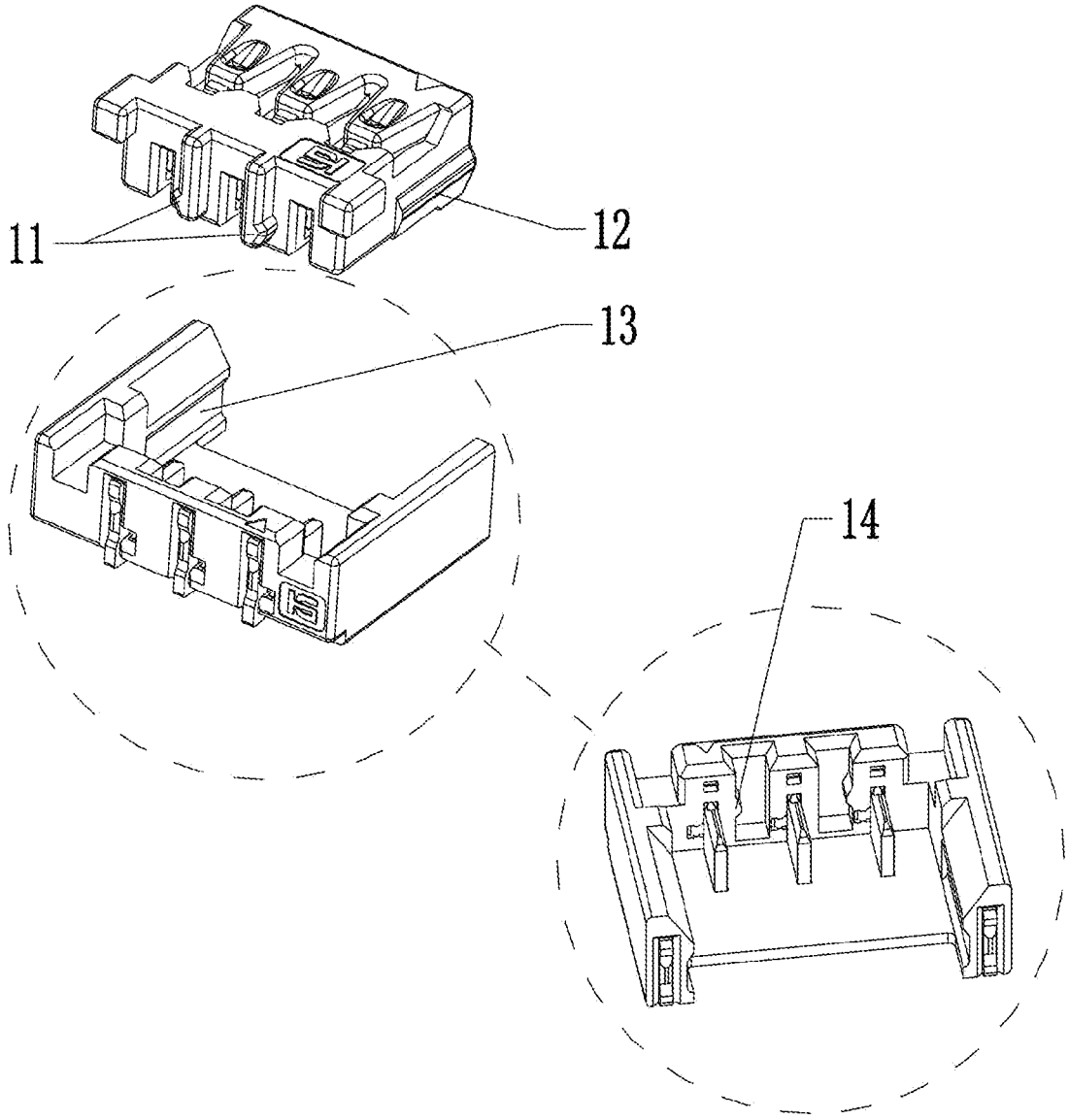
FIG. 5 is a schematic exploded view of a bottom plate and a housing according to an embodiment of the present disclosure.

As shown in FIG. 5, in this embodiment, a first buckling portion 11 located at a front end of the housing 1 and a pair of second engaging portions 12 respectively located on two sides of the housing 1 are disposed on the housing 1. Third engaging portions 13 adaptive to the second engaging portions 12 are respectively disposed on the pair of first side walls 6, and a fourth buckling portion 14 adaptive to the first buckling portion 11 is disposed on the second side wall 7. Specifically, the first buckling portion 11 is a vertically disposed protruding bar, and a tail end of the protruding bar is provided with a buckling protrusion. A vertically disposed groove adaptive to the protruding bar is disposed on an inner side of the second side wall 7, and the groove is provided with a protrusion adaptive to the first buckling portion 11, and the protrusion is the fourth buckling portion 14. The second engaging portions 12 and the third engaging portions 13 are convex ribs respectively disposed on the two sides of the housing 1, and grooves disposed on inner sides of the first side walls 6. The housing 1 may be detachably mounted on the bottom plate 3 through fitting between the first buckling portion 11 and the fourth buckling portion 14 and fitting between the second engaging portions 12 and the third engaging portions 13.

As shown in FIG. 6, a clamping wire portion 16 connected to the clamping piece portion 15 is further disposed on the conductive clamp 2, and the clamping wire portion 16 is used to connect to the conducting wire. The conducting wire whose insulation skin is removed can be electrically connected to the clamping wire portion 16. A structure of the clamping wire portion 16 is an existing technical means in the art. Details are not described herein.

In addition, as shown in FIG. 2, a clamping sheet 10 extending obliquely outwards is disposed at a bottom portion of the conductive clamp 2, and the clamping sheet 10 is capable of performing clamping on the housing 1. The clamping sheet 10 can ensure that the conductive clamp 2 does not fall off the mounting hole 9, thereby ensuring reliability of an electrical connection of the surface mount connector.

Based on the foregoing embodiment, the surface mount electrical connector in the solution can reliably implement a connection or a disconnection between the conducting wire and the PCB. In addition, it should be noted that the bottom plate 3 welded to the PCB has very small dimensions, and the conductive clamp is blocked by another electronic element on the PCB. Therefore, in an actual operation process, it is not easy to accurately mount the conductive clamp 2 on the bottom plate 3. However, in this solution, the housing 1 drives the conducting wire to be mounted on the bottom plate 3 from top to bottom. This can greatly facilitate mounting of the housing 1 and the bottom plate 3, thereby improving assembly efficiency of the housing and the bottom plate.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A surface mount connector, comprising:

a bottom plate, wherein the bottom plate has a bottom wall;

a conductive sheet, wherein the conductive sheet is disposed on the bottom plate, and a bottom portion of the conductive sheet runs through the bottom wall, the bottom portion being weldable to a PCB;

a housing, wherein the housing is detachably disposed on the bottom plate and is provided with a mounting hole corresponding to the conductive sheet; and a conductive clamp, wherein the conductive clamp is disposed in the mounting hole, and a clamping piece portion adaptive to the conductive sheet is disposed on the conductive clamp, wherein the housing is capable of driving the conductive clamp to be disposed on the bottom plate from a top to a bottom, so that the conductive sheet is inserted into the clamping piece portion, and the conductive clamp is electrically connected to the conductive sheet wherein the bottom plate has a pair of first side walls that are roughly parallel disposed on the bottom wall and protrude outward, and a second side wall that is disposed on the bottom wall and protrudes outward, the second side wall is perpendicular to the first side walls, and two ends of the second side wall are respectively connected to the pair of first side walls;

wherein the conductive sheet has a sheet-shaped body portion, a first limiting portion that is connected to the body portion and extends in a direction parallel to the body portion, and a second limiting portion that is connected to the body portion and extends outwards in a direction perpendicular to the body portion, and the second limiting portion and the first limiting portion are separately provided at the body portion and not directly connected with each other; a first clamping portion and a second clamping portion respectively adaptive to the first limiting portion and the second limiting portion are disposed on the second side wall.

2. The surface mount connector according to claim 1, wherein the conductive sheet is inserted into the second side wall from back to front.

3. The surface mount connector according to claim 1, wherein the surface mount connector comprises a pair of auxiliary weld legs respectively disposed on the pair of first side walls, and the weld legs are weldable to the PCB; a mounting opening is provided at the first side wall respectively along a length direction of the first side wall, and the mounting opening is opened from one side of the first side wall and penetrates a bottom of the first side wall, so that the weld legs are respectively inserted into the mounting opening along the length direction of the first side wall to disposed on the pair of first side wall.

4. The surface mount connector according to claim 1, wherein a first buckling portion located at a front end of the housing and a pair of second engaging portions respectively located on two sides of the housing are disposed on the housing; third engaging portions adaptive to the second engaging portions are respectively disposed on the pair of first side walls, and a fourth buckling portion adaptive to the first buckling portion is disposed on the second side wall.

5. The surface mount connector according to claim 1, wherein a cutting edge portion adaptive to the clamping piece portion is disposed at an upper portion of the body portion, and a thickness of the cutting edge portion decreases in an upward direction.

6. The surface mount connector according to claim 1, wherein a clamping wire portion connected to the clamping piece portion is disposed on the conductive clamp, and the clamping wire portion is used to connect to a conducting wire.

7. The surface mount connector according to claim 1, wherein a clamping sheet extending obliquely outwards is disposed at a bottom portion of the conductive clamp, and the clamping sheet is capable of clamping on the housing.

* * * * *